US005757273A

United States Patent [19]

Crandall et al.

[11] Patent Number: 5,757,273

[45] Date of Patent: May 26, 1998

[54] MULTIFUNCTIONAL PERSONAL ALERT SAFETY SYSTEM

[75] Inventors: Mark Crandall, San Marcos, Tex.; Mats Lundberg, Stockholm, Sweden; Stephan Andrew Samuelson, New Braunfels, Tex.

[73] Assignee: Detex Corporation, New Braunfels, Tex.

[21] Appl. No.: 606,408

[22] Filed: Feb. 23, 1996

[51] Int. Cl.[6] ..... G08B 23/00

[52] U.S. Cl. ..... 340/573; 340/626

[58] Field of Search ..... 340/573, 626

[56] References Cited

U.S. PATENT DOCUMENTS

| | | | |
|---|---|---|---|
| 4,914,422 | 4/1990 | Rosenfield et al. | 340/573 |
| 4,926,159 | 5/1990 | Bartlett | 340/384.6 |
| 4,949,072 | 8/1990 | Comerford et al. | 340/573 X |
| 4,999,606 | 3/1991 | Comerford et al. | 340/573 X |
| 5,278,414 | 1/1994 | Samuelson et al. | 250/349 |
| 5,317,305 | 5/1994 | Campman | 340/573 |
| 5,438,320 | 8/1995 | Taylor | 340/573 |

*Primary Examiner*—Thomas Mullen
*Attorney, Agent, or Firm*—E. Lieberstein

[57] ABSTRACT

The multifunctional personal alert safety system of the present invention includes a portable safety monitoring device which is removably coupled for independent operation to an external self contained breathing apparatus (SCBA) containing a source of pressurized air. The portable safety monitoring device comprises a motion sensor unit, an alarm and a control having an activated position and a deactivated position. In addition the system includes a pressure switch which is responsive to the flow of pressurized air from said self contained breathing apparatus above a predetermined minimum level for causing the control to activate putting the motion sensor unit and alarm in an operational mode. Once in an operational mode the motion sensor and alarm remain operational independent of further operation of the pressure switch. A manual switch is also included for operating the portable monitoring safety device independent of the self contained breathing apparatus when the control is deactivated.

6 Claims, 6 Drawing Sheets

MULTIFUNCTIONAL PERSONAL ALERT SAFETY SYSTEM

FIELD OF THE INVENTION

This invention relates to personal alert safety systems ("PASS") and more particularly to a multifunctional personal alert safety system which can be operated as a stand alone PASS unit or coupled for automatic operation to a self contained breathing apparatus ("SCBA").

BACKGROUND OF INVENTION

Personal Alert Safety Systems (PASS) are devices which are worn by personnel that work in isolated and dangerous environments such as, for example, firefighters, industrial workers, chemical workers and security guards to provide an alarm when the person wearing the device has become incapacitated. The PASS device monitors the movement of the wearer to determine if a threshold of alertness is satisfied and sounds an alarm or activates other means of indicia when movement of the wearer is determined to be abnormal. PASS devices have been used in the past as stand alone units or integrated into self contained breathing apparatus ("SCBA") consisting of a source of pressurized air, an air regulator and a mask. When integrated into an SCBA the conventional PASS device is not operational independent of the operation of the SCBA. The present invention is a multifunctional personal alert safety system for enabling personal alert safety monitoring equipment to be connected to an SCBA system for automatic control in response to the presence of air pressure from an SCBA or to be disconnected from the SCBA system for independent operation as a stand alone safety monitoring device when the SCBA system is not required. It is important that the PASS device remain operational for as long as it is connected to an SCBA with its source of pressurized air turned on. It is also desirable for the PASS device to be portable and operational independent of the SCBA. This is accomplished in accordance with the present invention using a portable safety monitoring device comprising a pressure switch, motion sensor means, alarm means, and control means activated by the pressure switch in response to the flow of pressurized air from a self contained breathing apparatus to which it is removably coupled. The portable safety monitoring device also includes manually operable switch means for operating said portable monitoring safety device independent of said self contained breathing apparatus when said control means is deactivated and the flow of pressurized air turned off.

It is therefore the primary object of the present invention to provide a multifunctional personal alert safety system having a pressure switch and manual control switch which will automatically activate a PASS unit in response to a predetermined minimum pressure threshold level from a source of air pressure in a standard breathing apparatus or to permit the personal alert safety system to operate as an independent stand alone PASS unit.

SUMMARY OF THE INVENTION

The multifunctional personal alert safety system of the present invention includes, in combination, a portable safety monitoring device and means for removably coupling said portable safety monitoring device to an external self contained breathing apparatus (SCBA) having a source of pressurized air, with said portable safety monitoring device comprising motion sensor means, alarm means, control means having an activated position and a deactivated position, pressure switch means responsive to the flow of pressurized air from said self contained breathing apparatus above a predetermined minimum level for causing said control means to activate, with said control means maintaining said motion sensor means and alarm means in an operational mode independent of further operation of the pressure switch when in said activated position and manually operable switch means for operating said portable monitoring safety device independent of said self contained breathing apparatus when said control means is in said deactivated position. The motion sensing means activates the alarm means to deliver a directional sound alarm in the event the wearer becomes motionless for a fixed time period of e.g. 30 seconds with a deviation of +/−5 seconds.

BRIEF DESCRIPTION OF THE DRAWINGS

Other features and advantages of the present invention will become apparent from the following detailed description of the invention when read in conjunction with the accompanying drawings of which.

DETAILED DESCRIPTION OF THE INVENTION

Figure 1:
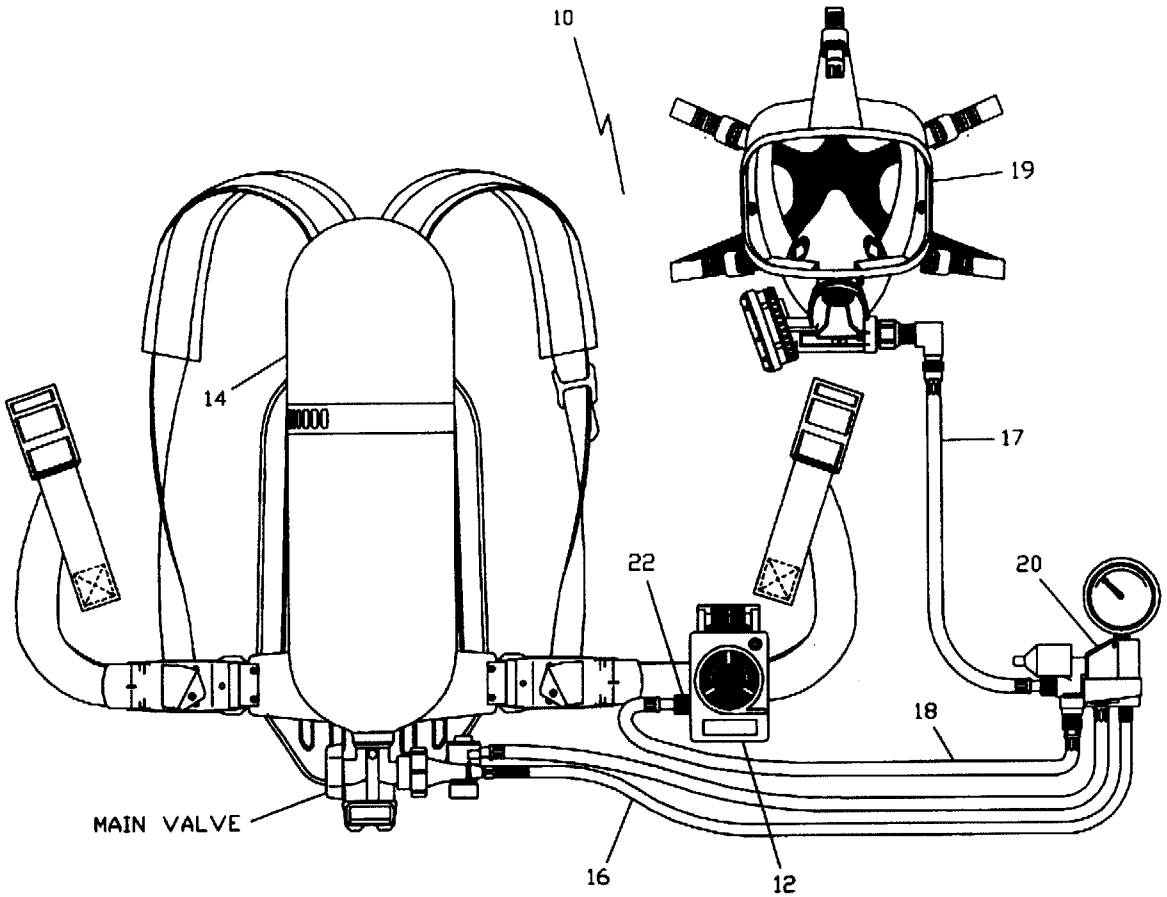
FIG. 1 is an schematic diagram illustrating a self contained breathing apparatus (SCBA) in combination with the portable safety monitoring device of the present invention.

The drawing of FIG. 1 shows a self contained breathing apparatus ("SCBA") 10 in combination with a portable safety monitoring device 12 and coupling member 22 for removably coupling the portable safety monitoring device 12 to the SCBA 10. The SCBA 10 comprises a pressurized supply tank 14, pressure hose lines 16, 17 and 18, an air breathing mask 19 and a regulator 20. The pressurized supply tank 14 may be turned on or off by a manual valve. In the valve on position the supply tank delivers to the breathing mask 19 a pressurized supply of air through the air hose line 17. The air pressure is regulated by the pressure regulator 20. The air hose 18 interconnects the regulator 20 to the portable safety monitoring device 12 through an adaptive coupling member 22 located at the distal end thereof. The coupling member 22 may be threaded to screw into the unit 12 or may be coupled using a bayonet coupling (not shown) to provide a manual quick disconnect for attachment of the pressure hose 18 to the portable safety monitoring device 12.

Figure 2A:
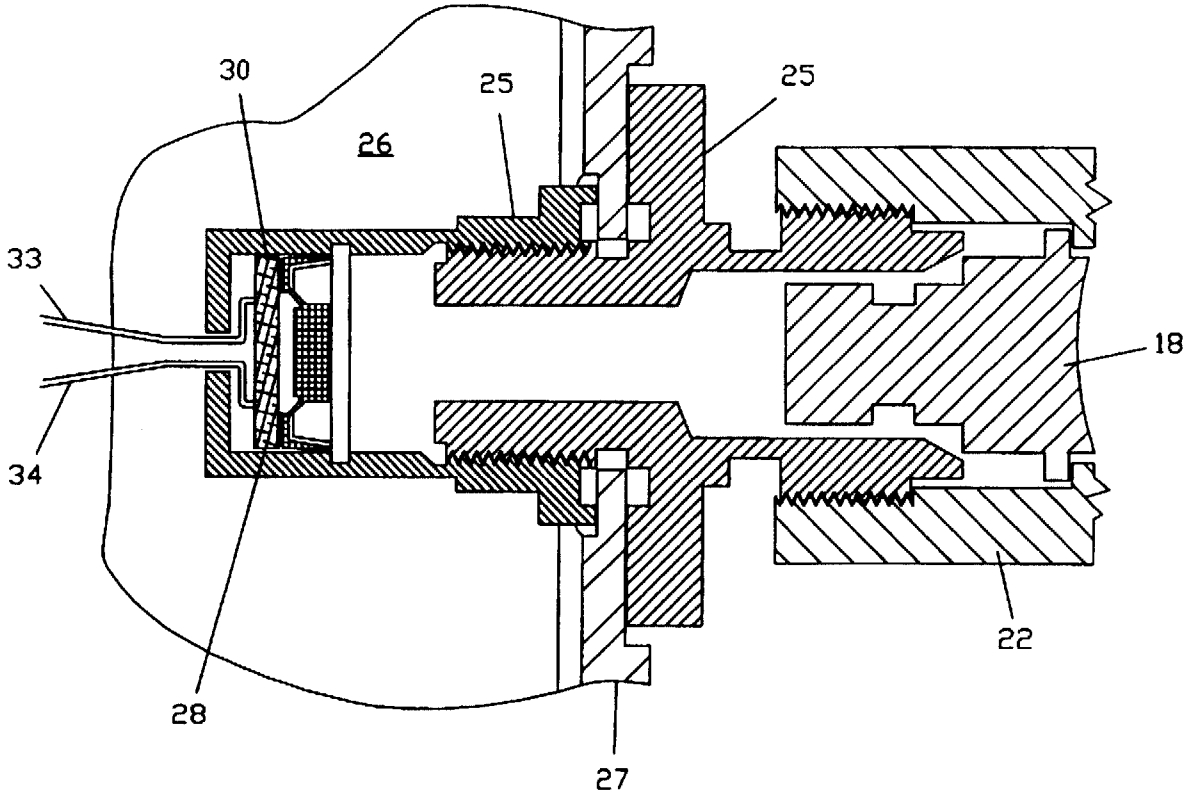
FIG. 2A is a schematic drawing of the pressure switch in the portable safety monitoring device in FIG. 1.
Figure 2B:
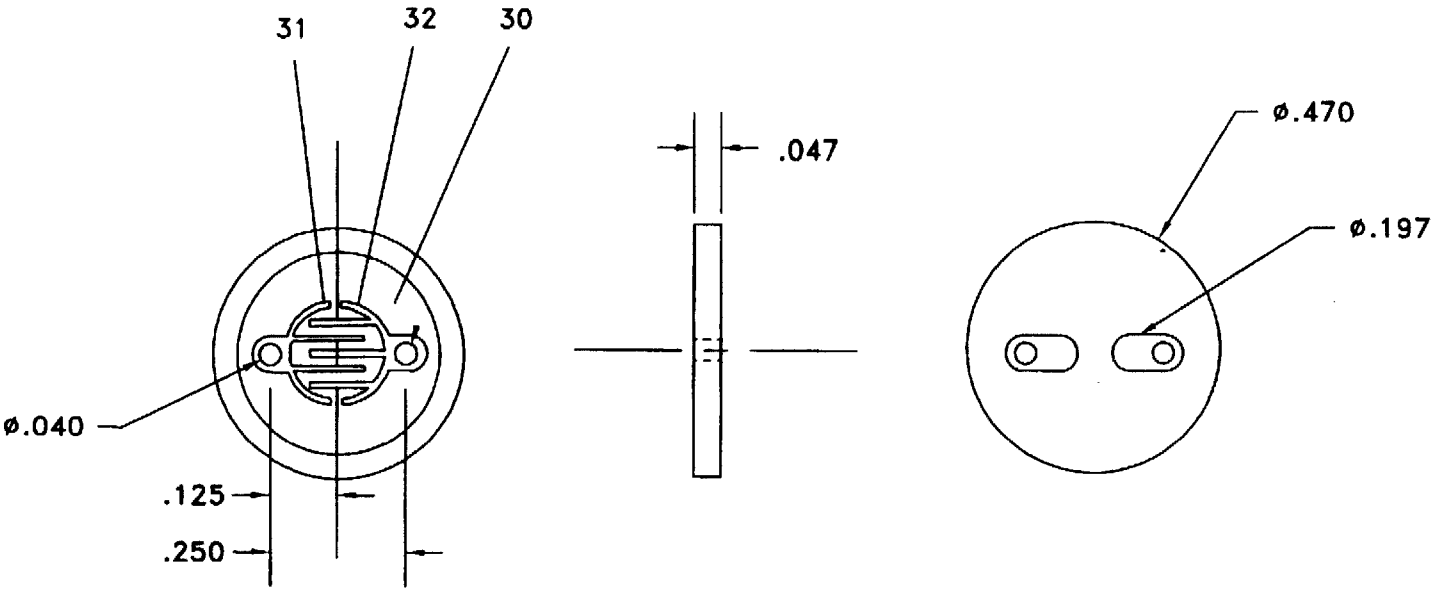
FIG. 2B is a circuit configuration of the conductor wiring of the printed circuit board in the pressure switch of FIG. 2A.

The portable safety monitoring device 12 contains a pressure switch 25 as shown in FIG. 2A having a housing 26 affixed to the outer casing 27 of the portable safety monitoring device 12 into which the pressure hose 18 is inserted. The pressure switch 25 has a movable relatively elastic conductive rubber plunger 28 and a printed circuit board 30 maintained a fixed distance apart in housing 26 during normal operation of the pressure switch 25. The printed circuit board 30 contains two etched wire conductors 31 and 32 in close proximity to one another as shown in FIG. 2B and preferably in a serpentine arrangement. Wire leads 33 and 34 extend from the wire conductors 31 and 32 of the pressure switch 25. The elastic conductive rubber plunger 28 will expand in response to air pressure in the pressure hose 18 above a predetermined minimum level. Upon expansion the elastic conductive rubber plunger 28 makes physical contact with the printed circuit board 30 for connecting the wire conductors 31 and 32 to one another thereby closing the pressure switch 25.

Figure 3A:
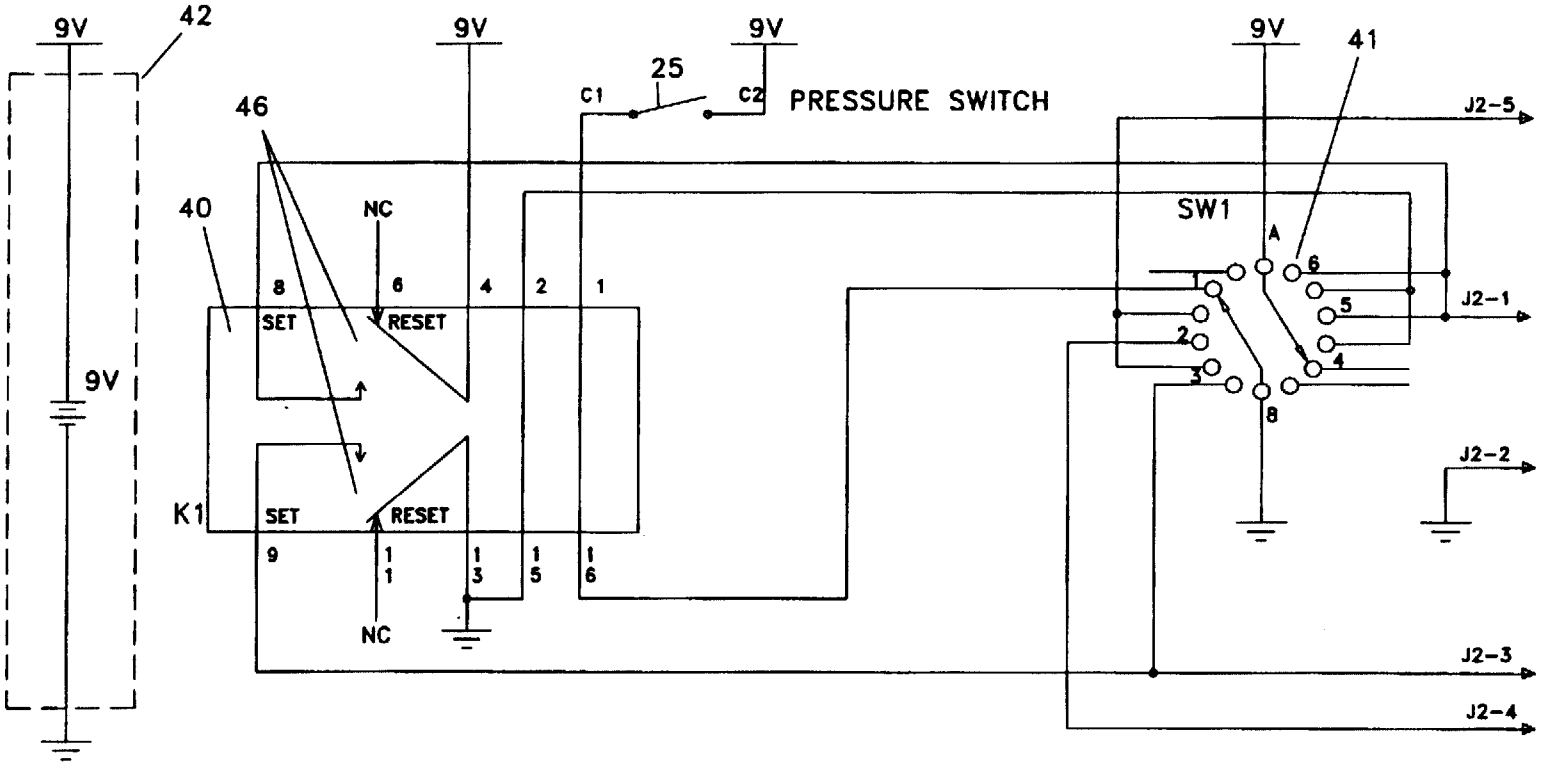
FIGS. 3A and 3B are interconnected as shown to form a single schematic electrical diagram of the portable safety monitoring device of the present invention with the pressure switch of FIG. 2A functionally illustrated.
Figure 3B:
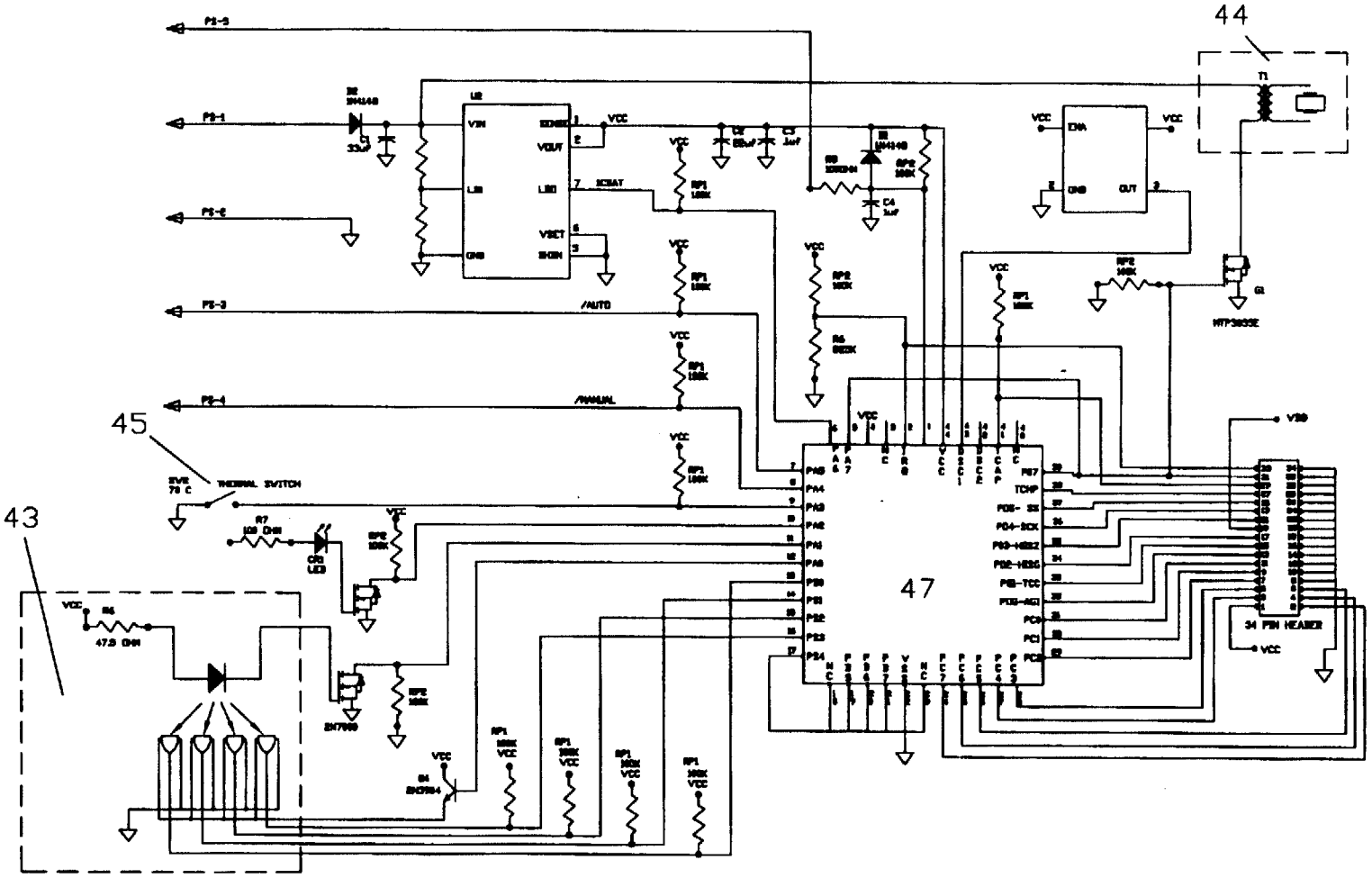

The pressure switch 25 is functionally represented as a manual switch in the electrical circuit schematic wiring diagram of FIG. 3. The circuit as shown in FIG. 3 includes a latching relay 40, a manually operated rotary switch 41, a power supply 42, a motion sensor 43 and a directional alarm sounder 44. A thermally operated switch 45 is optional. The circuit also has a microcomputer 47. The rotary switch 41 has an off position, an on position and an automatic position. In the on position the directional alarm sounder 44 is activated whereas in the automatic position the directional alarm sounder 44 is activated after the motion sensor 43 is activated. In the automatic or off positions the latching relay 40 will be activated when the portable safety monitoring device 12 is connected to an external SCBA with its pressurized air supply turned on. Once the latching relay 40 is activated the motion sensor 43 and the directional alarm sounder 44 remain in an operational mode and will cause an alarm should the operator remain inactive long enough to activate the motion sensor 43. The latching relay 40 is deactivated when the pressurized air supply from the SCBA is turned off and the rotary switch 41 is turned from off to automatic and back to off. The portable safety monitoring device 12 is always in the on mode by switching the rotary switch 41 to "ON". The portable safety monitoring device 12 may be disconnected from the SCBA and operated as an independent unit from the rotary switch 41. As an independent unit the portable safety monitoring device 12 operates through the rotary switch 41 in the automatic position or in on position independent of whether the latching relay was restored to the deactivated position or not provided the pressurized air supply from the SCBA has been disconnected or is turned off. The latching relay 40 is a conventional device which has open contacts 46 which close when the relay 40 is energized thereby holding the latching relay 40 in the activated position even if the pressure switch 25 opens. Once the latching relay 40 is activated power from the power supply 42 continues to be applied to the motion sensor 43 whether the manual rotary switch 41 is off or in the automatic position. Power is applied directly to the directional alarm sounder 44 in the rotary "on" position. Once power is removed from the latching relay 40 it deactivates. This is preferably accomplished in the circuit of FIG. 3 by the microcomputer 47 upon switching the rotary switch 41 in a predetermined sequence which the microcomputer 47 can readily be programmed to detect. The preferred sequence includes switching rotary switch 41 from the off position to the automatic position and back. Although a latching relay 40 is used as the control means to establish an activated position after air pressure is detected which stays activated independent of further operation of the pressure switch other control mechanisms may likewise be used.

The directional alarm sounder 44 when activated delivers a directional sound alarm in the event the wearer becomes motionless for a fixed time period of e.g. 30 seconds. It may be activated directly by rotation of the manual switch 41 to the on position or through the activation of the motion sensor 43. Although any conventional motion sensor 43 may be used the preferred motion sensor is taught in U.S. Pat. No. 5,278,414 the disclosure of which is herein incorporated by reference and the preferred directional alarm is taught in U.S. Pat. No. 4,962,159 the disclosure of which is also herein incorporated by reference. As taught in the aforementioned patent the motion sensor is an optical device consisting of a housing having a chamber which encloses a ball which freely moves in the chamber. Light is projected into the chamber along a first axis and is detected at a given angular axis relative to the first axis. The ball as it freely moves in the chamber obscures the detection of the light. The projected light is then turned on and off at a given frequency so that the output of the light detectors can be used to detect motion variances which affect ball movement. In this way when the motion of the wearer of unit 12 is not normal indicating a disabled wearer the output of the light detectors activates an alarm to produce directional sound so that the disabled wearer may be readily found.

Figure 4:
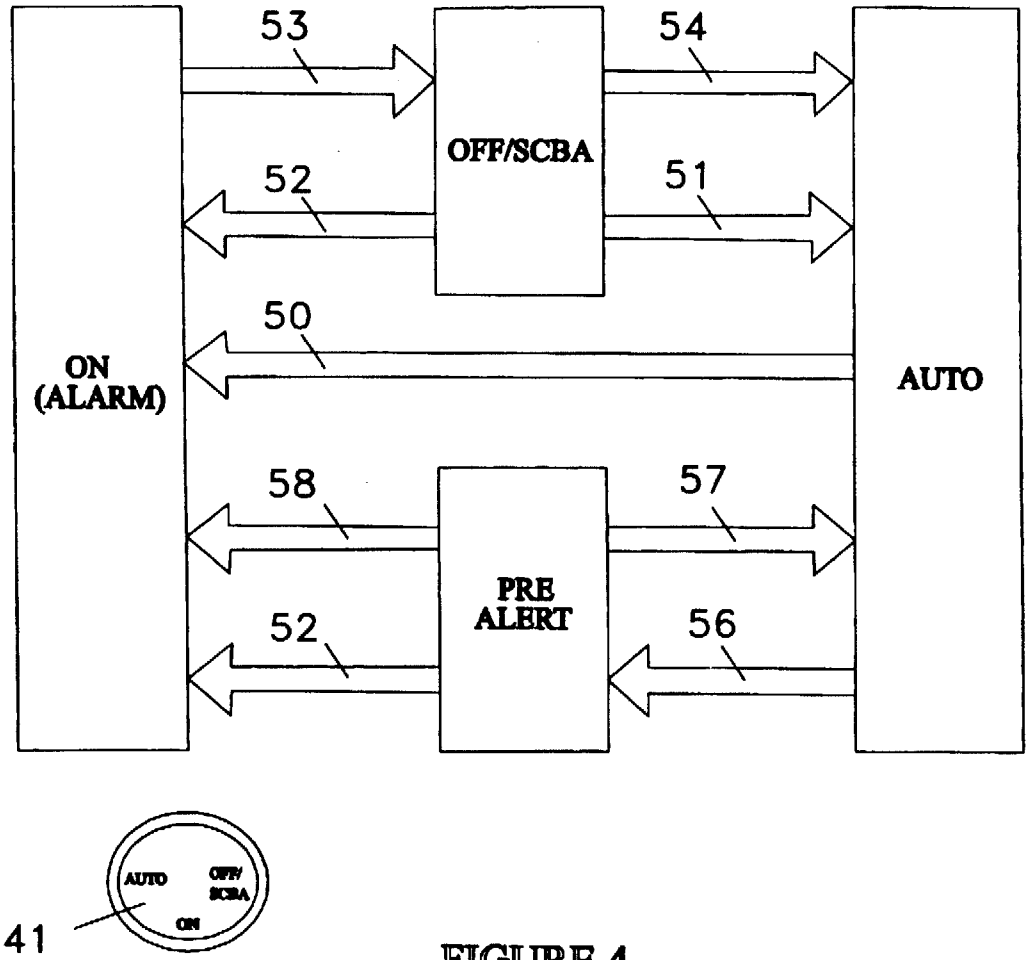
FIG. 4 is logical flow chart of the functional operation of the multifunctional personal alert safety system of the present invention.

As shown in the logical flow diagram of FIG. 4 the unit 12 may be activated when used in conjunction with an SCBA by sensing the presence of pressurized air or may be activated independent of the SCBA by rotating the manual switch 41 to the automatic position. Reference flow line 50 designates the manually operated independent alarm condition of the unit 12. The PASS may also be activated by having the SCBA pressure "ON" identified by reference flow line 51 or by the knob 41 moved to the automatic position identified by reference flow lines 52. If in the "ON" mode and the knob 41 is in the "ON" position the knob 41 has to be pushed down and turned to "OFF" to turn the PASS off as identified by reference flow line 53. If in the ON mode and the knob 41 is in the OFF position the knob 41 should be moved from on back to off to turn the PASS off as indicated by reference flow line 54. A prealert condition is activated through the operation of the microprocessor 47 which monitors the state of the motion sensor 43 in order to give the operator a prealert signal through the directional sounder if inactivity i.e. lack of movement is detected for a reduced time period. The PASS is put on PRE ALERT after 22 seconds of inactivity if in AUTO mode as indicated by reference flow line 56. If in PRE ALERT and movement occurs within 8 seconds the PASS is put in AUTO mode as indicated by reference flow line 57. If in PRE ALERT and no movement occurs within 8 seconds the PASS is put in the ON mode as indicated by reference flow line 58.

What is claimed is:

1. A multifunctional personal alert safety system comprising in combination, a portable safety monitoring device and means for removably coupling said portable safety monitoring device to an external self contained breathing apparatus (SCBA) having a source of pressurized air, with said portable safety monitoring device comprising motion sensor means, alarm means, control means having an activated position and a deactivated position, pressure switch means responsive to the flow of pressurized air from said self contained breathing apparatus above a predetermined minimum level for causing said control means to activate, with said control means maintaining said motion sensor means and alarm means in an operational mode when said control means is in the activated position independent of further operation of the pressure switch and manually operable switch means for operating said portable monitoring safety device independent of said self contained breathing apparatus, said control means comprising latching means and circuit means with said circuit means being connected to said pressure switch for activating said latching means upon activation of said pressure switch and including microprocessor means for deactivating said latching means in response to a predetermined sequence of operation of said manually operable switch means.

2. A multifunctional personal alert safety system as defined in claim 1 wherein said latching means comprises a latching relay.

3. A multifunctional personal alert safety system as defined in claim 1 wherein said manually operable switch means includes an on position for directly operating said alarm means.

4. A multifunctional personal alert safety system as defined in claim 1 wherein said pressure switch comprises a housing having an elastic conductive member spaced apart from wire conductors such that in response to a predetermined air pressure from said source of pressurized air said elastic member is caused to contact said wire conductors to form a closed electrical contact.

5. A multifunctional personal alert safety system as defined in claim 4 wherein said wire conductors are etched on a printed circuit board mounted in said housing.

6. A multifunctional personal alert safety system as defined in claim 5 wherein said means for coupling said pressure switch assembly to a self contained breathing apparatus (SCBA) is an adaptive coupling having means for quickly engaging and disengaging the pressure switch apparatus to the SCBA apparatus.

* * * * *